US006067658A

United States Patent [19]

Cho

[11] Patent Number: 6,067,658

[45] Date of Patent: May 30, 2000

[54] FREE-SIZE CAP

[75] Inventor: Byoung-Woo Cho, Seoul, Rep. of Korea

[73] Assignee: Yupoong & Co., Ltd, Seoul, Rep. of Korea

[21] Appl. No.: 09/426,627

[22] Filed: Oct. 26, 1999

[51] Int. Cl.[7] ..... A42B 5/00

[52] U.S. Cl. ..... 2/181; 2/200.1

[58] Field of Search ..... 2/181, 175.1, 195.1, 2/200.1; 139/420 R, 421, 422

[56] References Cited

U.S. PATENT DOCUMENTS

| | | | |
|---|---|---|---|
| 3,309,713 | 3/1967 | Kaufman | 2/183 |
| 3,337,877 | 8/1967 | Lipkin | 2/172 |
| 3,661,692 | 5/1972 | Berczi | 161/89 |
| 3,707,120 | 12/1972 | Schroeder | 161/90 |
| 5,715,540 | 2/1998 | Cho | 2/195.3 |
| 5,915,534 | 6/1999 | May | 2/181.4 |
| 5,920,910 | 7/1999 | Calvo | 2/181.4 |

*Primary Examiner*—Bibhu Mohanty
*Attorney, Agent, or Firm*—Armstrong, Westerman, Hattori, McLeland & Naughton

[57] ABSTRACT

A free-size cap is disclosed. In the free-size cap of this invention, the gores of the crown are made of double-knit weft knitted fabrics having a weft directional elongation higher than 50%. The crown thus has a high ventilation effect, a high flexibility, a desired tightness, and allows a user to feel comfortable while wearing the cap. The free-size cap is also designed in that one reference-sized cap is commonly and freely usable by users having head sizes different from each other within a difference of about 12 cm. The free-size cap of this invention is further provided with a sweat band made of an elastic woven fabric having both a weft directional elongation higher than 65% and an elastic recovery higher than 95%, thus almost completely overcoming the problem of a row elastic recovery derived from the crown made of such weft knitted fabrics. The elastic woven fabric of the sweat band is manufactured by weaving latex-covered yarns as wefts and non-stretchable yarns as warps. In the present invention, double pile weft knitted fabrics may be used as the double-knit weft knitted fabric of the gores. In addition, the double-knit weft knitted fabric of the gores may be manufactured using polyurethane-covered yarns as wefts.

3 Claims, 3 Drawing Sheets

FREE-SIZE CAP

BACKGROUND OF THE INVENTION

1. Field of the Invention

The present invention relates, in general, to free-size caps and, more particularly, to a free-size cap with the gores of the crown being made of double-knit weft knitted fabrics having a weft directional elongation higher than 50%, the crown thus having a high ventilation effect, a high flexibility, a desired tightness, and allowing a user to feel comfortable while wearing the cap, the free-size cap being also designed in that one reference-sized cap is commonly and freely usable by users having head sizes different from each other within a difference of about 12 cm, the free-size cap being further provided with a sweat band made of an elastic woven fabric having both a weft directional elongation higher than 65% and an elastic recovery higher than 95%, thus almost completely overcoming the problem of a row elastic recovery derived from the crown made of such weft knitted fabrics.

2. Description of the Prior Art

As well known to those skilled in the art, free-size caps or caps of the one-size-fits-all type are designed in that one reference-sized cap is commonly usable by users having different head sizes within a range. Conventional free-size caps may be referred to Korean Patent No. 92,219 or U.S. Pat. No. 5,715,540. In the above free-size caps, the crown comprises six gores individually made of an elastic woven fabric manufactured by weaving polyurethane monofilament yarns, such as spandex yarns, as wefts and non-stretchable yarns as warps. In addition, the sweat band for the above free-size caps is made of an elastic woven fabric manufactured by weaving polyurethane monofilament yarns as wefts and non-stretchable yarns as warps in the same manner as that described for the crown.

However, such a conventional free-size cap is problematic in that the elastic woven fabric of the crown undesirably has a low elongation and a low elastic recovery since the fabric is manufactured by binding stretchable wefts and non-stretchable warps together. Due to the low elongation and low elastic recovery, the above free-size cap, manufactured at a single reference size, is only usable by users having head sizes different from each other within a difference of about 6 cm, more precisely, 6.35 cm (about 2.5 inches). In a detailed description, the conventional small-sized free-size caps (54 cm) are usable by users having head sizes of 54 cm~60 cm, the medium-sized free-size caps (60 cm) are usable by users having head sizes of 60 cm~66 cm, and the large-sized free-size caps (66 cm) are usable by users having head sizes of 66 cm~72 cm. Therefore, it is necessary for users, having head sizes of 54 cm~72 cm, to individually select one of the three types of free-size caps. This finally limits use of the conventional free-size caps. In addition, since the elastic woven fabric of the crown has an effective elongation of 25%±2%, the crown of the conventional free-size caps is somewhat stiff and fails to allow a user to feel comfortable while wearing a cap.

The sweat band of the above free-size caps is made of an elastic woven fabric using polyurethane monofilament yarns as stretchable wefts. The sweat band thus fails to have a desired elongation higher than 65% or a desired elastic recovery higher than 95%, both being necessarily needed to accomplish both a desired flexibility and a desired touch of sweat bands.

The conventional free-size caps are designed to be usable by users, having head sizes of 54 cm~72 cm. However, a recent research report discloses that such free-size caps are mainly used by persons having head sizes of 45 cm~69 cm, or by infants, youngsters and adults. The conventional free-size caps thus fail to completely meet a requirement of such main users of the recent years.

U.S. Pat. No. 3,337,877 discloses a free-size cap, of which the side and rear gores of the crown are individually made of a foam material, such as sponge, with tricot warp knitted fabrics being attached to both surfaces of the foam material using a bonding agent. This free-size cap is originally designed to be stretchable in a horizontal direction at the side and rear gores of the crown and to allow a user to feel comfortable due to the cushion of the foam material while wearing the cap.

However, since the tricot warp knitted fabrics are attached to both surfaces of the foam material using a bonding agent, the crown fails to accomplish a desirable elongation. The elongation and elastic recovery of the above cap are only determined by those of the foam material, and so the use of one reference-sized cap is limited. It is thus necessary for manufacturers of caps to produce a plurality of reference-sized caps in order to meet a requirement of users having different head sizes. In addition, the front portion of the crown corresponding to the forehead of a user is free from a sweat band, and so the cap fails to effectively and quickly absorb and remove sweat from the forehead of the user. The cap thus undesirably allows sweat to flow from the forehead down on the face of the user, thereby being inconvenient to the user while wearing the cap. Another problem of the above free-size cap resides in that the elastic recovery of the crown is remarkably reduced at the side and rear gores made of the foam material covered with the tricot warp woven fabrics when the cap is used for a lengthy period of time. In such a case, it is impossible for the cap to be comfortably fitted on the head of a user, and so the cap loses the desired tightness.

SUMMARY OF THE INVENTION

Accordingly, the present invention has been made keeping in mind the above problems occurring in the prior art, and an object of the present invention is to provide a free-size cap, of which the gores of the crown are made of double-knit weft knitted fabrics having a weft directional elongation higher than 50%, and which has a sweat band made of an elastic woven fabric manufactured by weaving latex-covered yarns as wefts and conventional non-stretchable yarns as warps and having both a weft directional elongation higher than 65% and an elastic recovery higher than 95%. One reference-sized free-size cap of the present invention is commonly usable by persons having head sizes different from each other within a range of 12 cm. It is thus possible for main users having head sizes of 45 cm (infants) ~69 cm (adults) to select one of two reference-sized free-size caps, or small-sized caps (45 cm) and medium-sized caps (57 cm). Since the crown of this free-size cap is made of weft knitted fabrics which are soft and smoothly stretchable, the cap of this invention is appropriately and comfortably fitted to the head of a user and allows the user to feel comfortable while wearing the cap. The double-knit weft knitted fabric of the crown of this invention has loops with a great number of ventilation pores acting as means for diffusing moisture from the interior of the crown into the atmosphere. Therefore, the free-size cap of this invention is free from conventional eyelets and effectively and quickly diffuses moisture, such as sweat, into the atmosphere through the ventilation pores of the loops.

The sweat band of this invention, having a high elastic recovery, effectively compensates for the low elastic recovery of the crown made of weft knitted fabrics using non-stretchable yarns as warps.

In the present invention, in order to allow the crown of the free-size cap of this invention to have a desired elongation in weft and warp directions, a desired elastic recovery and a desired flexibility, the crown of this invention may be made of a double-knit weft knitted fabric using polyurethane-covered yarns. In such a case, the crown of the free-size cap has a vertical elongation higher than 25% and a horizontal elongation higher than 60%. A conventional weft knitted fabric using non-stretchable yarns has a single-knit weft directional elongation of 30%~50% which is created by the stretchable loops continuously formed in a weft direction of the weft knitted fabric. Therefore, the weft knitted fabric using non-stretchable yarns is not stretchable in a vertical direction. In addition, when the crown of the free-size cap of this invention is made of a double-knit weft knitted fabric using conventional non-stretchable yarns, the elastic recovery of the crown is not higher than 80%. In order to compensate for the low elastic recovery of the crown of this free-size cap, the crown is integrated with a sweat band having a high elastic recovery higher than 95%.

In order to accomplish the above object, the present invention provides a free-size cap, comprising: a plurality of gores integrated into a crown and made of a double-knit weft knitted fabric having a weft directional elongation higher than 50%; and a sweat band attached along a lower edge of the integrated gores and made of an elastic woven fabric, said elastic woven fabric of the sweat band being manufactured by weaving latex-covered yarns as wefts and non-stretchable yarns as warps and having both a weft directional elongation higher than 65% and an elastic recovery higher than 95%.

Since the crown of the free-size cap of this invention is made of the double-knit weft knitted fabric, the crown has loops with a great number of ventilation pores acting as a means for diffusing moisture from the interior of the crown into the atmosphere. Therefore, the free-size cap of this invention is free from conventional eyelets and effectively and quickly diffuses moisture, such as sweat, into the atmosphere through the ventilation pores of the loops.

In the present invention, the sweat band of the free-size cap is made of an elastic woven fabric using latex-covered yarns as wefts. Since the latex-covered yarns have a high elongation and a high elastic recovery different from conventional polyurethane-covered yarns, the sweat band is softer and more flexible, and has a porous structure, thus more quickly and effectively absorbing and diffusing a large amount of sweat. In addition, since the sweat band of this invention has a high elastic recovery, it effectively compensates for the low elastic recovery of the crown made of weft knitted fabrics using non-stretchable yarns as warps.

When the crown of this invention is made of a double-knit weft knitted fabric using polyurethane-covered yarns, the crown has a weft directional elongation higher than 25% and a horizontal elongation higher than 60%. In such a case, the crown of the cap is more stably and comfortably fitted to the head of a user. In addition, the elastic recovery of the above crown is remarkably increased over the crown made of weft knitted fabrics using non-stretchable yarns.

In the present invention, the free-size cap may be designed to have a conventional size adjusting means at the center of the lower edge of the crown as shown in FIGS. 2 and 3. Alternatively, the free-size cap of this invention may be designed without having such a size adjusting means as shown in FIG. 1.

The crown of the free-size cap of this invention may be made of a double pile weft knitted fabric. In such a case, the free-size cap has a soft touch and a high thermal insulation effect, thus being preferably used in the winter or in cold climate.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
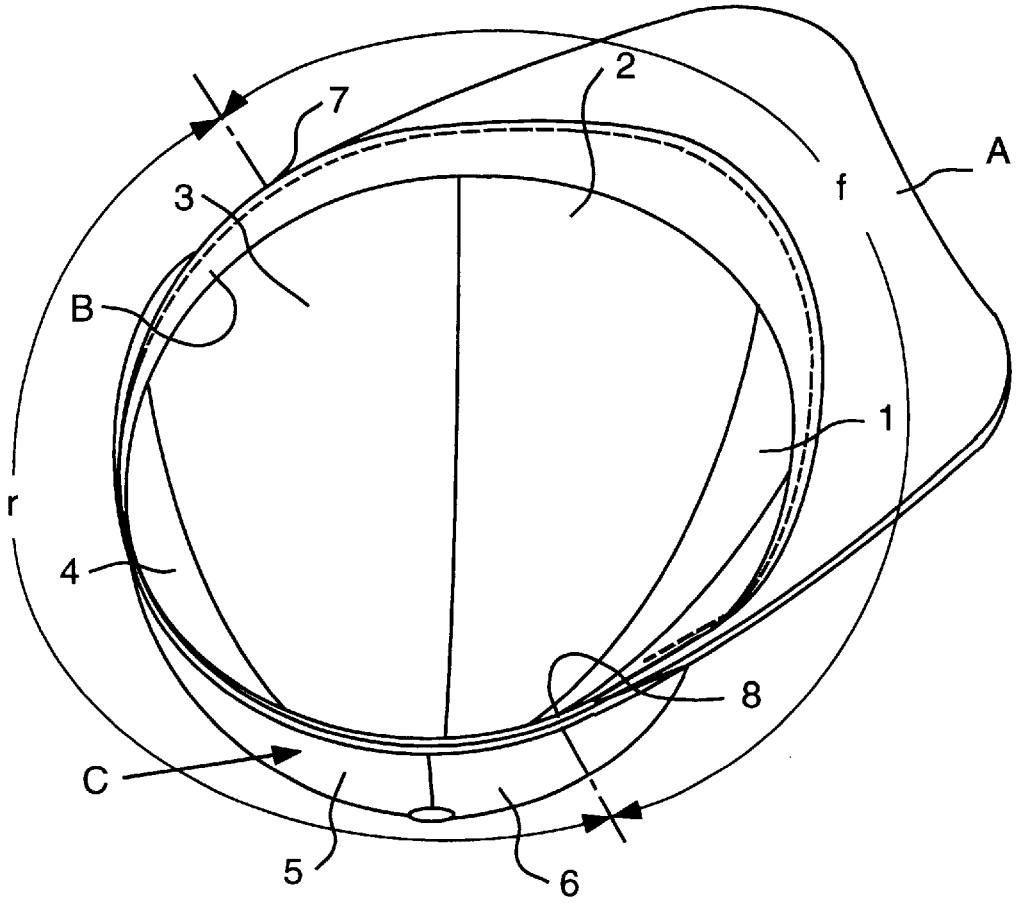
FIG. 1 is a bottom perspective view of a free-size cap in accordance with the primary embodiment of the present invention, the cap being free from a size adjusting means.

FIG. 1 is a bottom perspective view of a free-size cap in accordance with the primary embodiment of the present invention, the cap being free from a size adjusting means.

In the present invention, the free-size cap is designed to be freely used by users having head sizes of 45 cm~69 cm and is manufactured as two reference-sized caps, or small-sized caps (45 cm) and medium-sized caps (57 cm), capable of meeting a requirement of the users having head sizes of 45 cm~69 cm. In the cap of this invention, the lower edge of the crown is divided into two parts, or a rear portion and a front portion, by both ends 7 and 8 of a visor 'A'. When setting 't' as the reference size of a free-size cap, 'r' as the circumferential length of the rear portion, and 'f' as the circumferential length of the front portion, the free-size cap of this invention is designed to accomplish the expressions, $\frac{3}{5}\times t \leqq r$, and $t=r+f$.

In the free-size cap of this invention, the crown 'C' and the sweat band 'B' are designed to be practically stretchable at the rear portion.

Repeated experiments show the following results. That is, when a small-sized free-size cap of this invention, with t=45 cm, is stretched at its rear portion by 90% or less of an elongation of 50%, the cap does not cause any inconvenience to a user irrespective of a restoring force acting on the head of the user due to the elastic recovery of the rear portion, but is comfortably fitted on the head of the user.

Therefore, the circumferential length 'r' of the rear portion of the cap is calculated as follows: $r=45\text{ cm}\times\frac{3}{5}=27$ cm. When the rear portion (r=27 cm) is stretched by 90% or less of the elongation of 50%, the rear portion is stretched by 12.15 cm (27 cm×0.5×0.9).

When a medium-sized free-size cap of this invention, with t=57 cm, is stretched in the same manner as described for the small-sized cap, the circumferential length 'r' of the rear portion of the cap is calculated as follows: $r=57\text{ cm}\times\frac{3}{5}=34.2$ cm and the rear portion is stretched by 15.3 cm (34.2 cm×0.5×0.9).

When the crowns of the free-size caps of this invention are made of double-knit weft knitted fabrics using non-stretchable yarns as warps and are manufactured at two reference sizes, or 45 cm and 57 cm, the free-size caps almost completely meet a requirement of users having different head sizes of 45 cm 69 cm. In practicality, the medium-sized free-size cap having a reference size of 57 cm also meets a requirement of a user having a head size of 72 cm since the stretched size of the cap becomes 72 cm (57 cm+15 cm).

The sweat band of the free-size cap of this invention has a weft directional elongation higher than 65%, and so the sweat band completely accomplishes the above-mentioned conditions.

Figure 2:
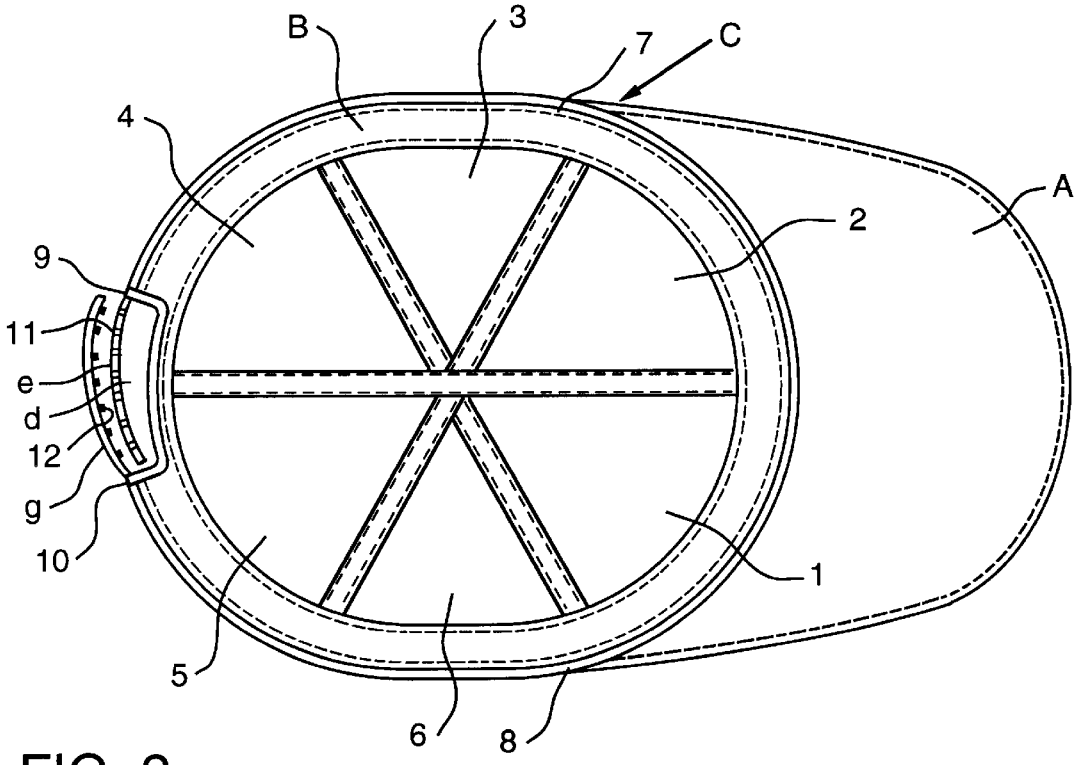
FIG. 2 is a bottom view of a free-size cap in accordance with the second embodiment of the present invention, the cap being provided with a size adjusting means, consisting of a male band and a female band, at the rounded cutout formed on the lower edge of the crown at the rear end.
Figure 3:
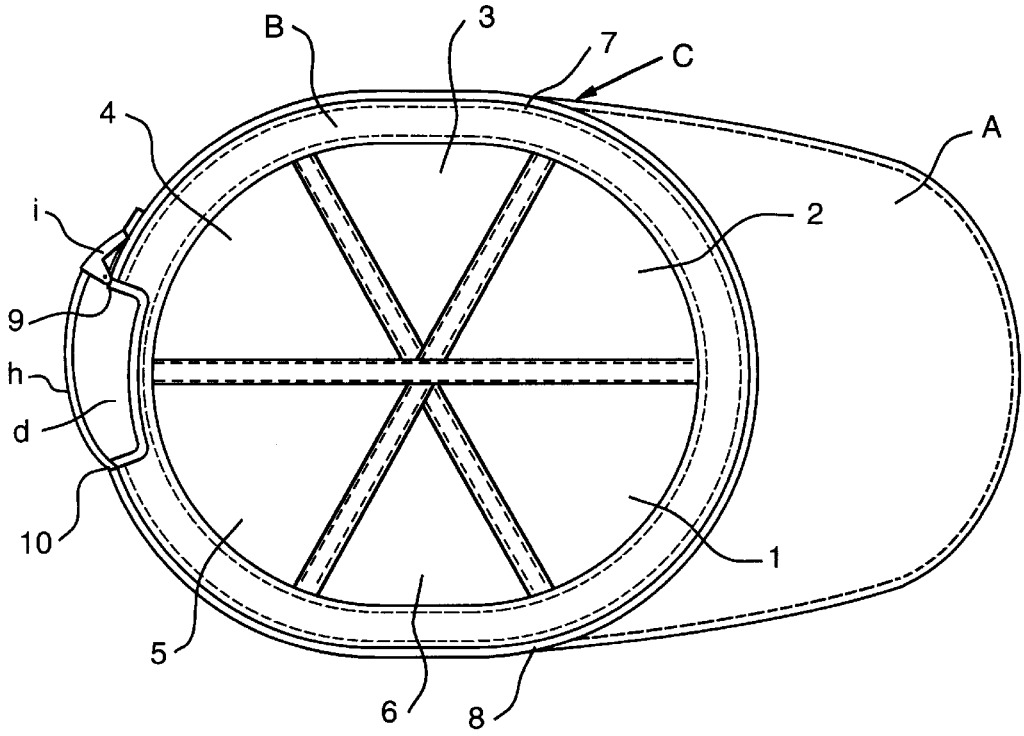
FIG. 3 is a bottom view of a free-size cap in accordance with the third embodiment of the present invention, the cap being provided with a size adjusting means, consisting of a band and a buckle, at the rounded cutout formed on the lower edge of the crown.

The present invention is also adapted to free-size caps with size adjusting means as shown in FIGS. 2 and 3.

In the free-size cap of FIG. 2, a cutout 'd', having a length of 10 cm and a width of 4 cm, is formed on the lower edge of the crown 'C'. A female band 'e', with a plurality of regularly spaced fitting holes 11 axially arranged on the band, is sewn to the first edge 9 of the cutout 'd' at one end thereof. A male band 'g', with a plurality of regularly spaced fitting projections 12 axially arranged on the band, is sewn to the second edge 10 of the cutout 'd'. It is possible for a user to primarily and approximately adjust the size of the cap by appropriately engaging the fitting projections 12 of the male band with the fitting holes 11 of the female band in a conventional manner.

In the above free-size cap, the final size adjustment, which is not accomplished by the size adjusting bands due to the intervals of the fitting holes and fitting projections, is automatically and precisely accomplished by both the crown and the sweat band provided at the portions between the first end 7 of the visor and the first edge 9 of the cutout and between the second end 8 of the visor and the second edge 10 of the cutout.

For example, when the free-size cap of FIG. 2 has a reference size of 57 cm and is designed to be commonly usable by users having head sizes different from each other within a difference of about 12 cm, the primary size adjustment within the first 6 cm (57 cm~63cm) is accomplished by the size adjusting bands with seven fitting holes be formed on the female band while being spaced out at regular intervals of 1 cm. The final size adjustment within the remaining 6 cm (12 cm~6 cm) is automatically and precisely accomplished by both the crown and the sweat band provided at the portions between the first end 7 of the visor and the first edge 9 of the cutout and between the second end 8 of the visor and the second edge 10 of the cutout. That is, since the circumferential length of the portion between the first end 7 of the visor and the first edge 9 of the cutout is 12.1 cm (34.2 cm/2–10 cm/2), the total circumferential length of the two portions between the first end 7 of the visor and the first edge 9 of the cutout and between the second end 8 of the visor and the second edge 10 of the cutout is 24.2 cm (12.1 cm×2). Therefore, when the rear portion of the cap is stretched by 90% of the elongation of 50%, the rear portion is stretched by 10.89 cm (24.2 cm×0.5×0.9). The rear portion is thus stretchable within a range of 10.89 cm, and so the final size adjustment within the remaining 6 cm (12 cm~6 cm) is precisely accomplished by the rear portion. The free-size cap of this invention, which has a reference size of 57 cm and is provided with the size adjusting bands, is usable by a user having a head size of 73 cm (larger than the reference size of 57 cm by 16 cm) in addition to a user having a head size of 69 cm (larger than the reference size of 57 cm by 12 cm). The final precise size adjustment within 1 cm, or the intervals between the fitting holes, is automatically accomplished by the portions with the total circumferential length, or 12.1 cm+12.1 cm.

In the free-size cap of FIG. 3, a buckle 'I' is sewn to the first edge 9 of the cutout 'd', while a band 'h' is sewn to the second edge 10 of the cutout 'd'.

The size adjustment of the above free-size cap is accomplished as follows. That is, the primary size adjustment within first 6 cm (57 cm~63 cm) is accomplished by the band and buckle, and the final size adjustment within the remaining 6 cm (12 cm~6 cm) is automatically and precisely accomplished by the portions with the total circumferential length, or 12.1 cm+12.1 cm in the same manner as that described for the cap of FIG. 2.

When the free-size cap of FIGS. 2 and 3 with a size adjusting means is designed to have a reference size of 63 cm instead of 57 cm, the size adjustment within a range of 12 cm is accomplished as follows.

That is, when the free-size cap of FIGS. 2 and 3 is designed to have a reference size of 63 cm with the cutout being open free from such a size adjusting means, it is possible to reduce the size of the cap within a range of 6 cm. In addition, the final size adjustment within the remaining 6 cm is automatically and precisely accomplished by the elasticity of both the crown and the sweat band at the portions with the total circumferential length, or 12.1 cm+12.1 cm.

In a brief description, the free-size cap of FIGS. 2 and 3 is appropriately adjusted in size as desired by both the size adjusting means and the elasticity of both the crown and the sweat band.

A better understanding of the present invention may be obtained through the following examples which are set forth to illustrate, but are not to be construed as the limit of the present invention.

EXAMPLE 1

In order to produce a free-size cap free from a size adjusting means as shown in FIG. 1, a double-knit weft knitted fabric was made using spun blend yarns, consisting of 65 wt % of polyester fiber and 35 wt % of cotton, through a circular weft knitting process. The resulting weft knitted fabric was divided into six gores 1 to 6 prior to integrating the six gores into a crown 'C' through a conventional sewing process using sewing yarns.

The weft directional elongation of the above weft knitted fabric was 50%.

In addition, a sweat band 'B' for the cap was manufactured as follows. That is, an elastic woven fabric, having a weft directional elongation of 65% and an elastic recovery of 95% and a width of 3 cm, was manufactured using latex-covered yarns as wefts and spun blend yarns as warps by a ribbon loom. In such a case, the latex-covered yarn, used as a weft, was manufactured using a latex monofilament yarn of 70*d* as a core yarn and a polyester multifilament yarn of 150*d* as a cover yarn. The spun blend yarn, used as a warp, consists of 65 wt % of polyester fiber and 35 wt % of cotton. The desired sweat band 'B' was made of the resulting elastic woven fabric.

In the free-size cap, the circumferential length of both the lower edge of the crown and the sweat band was 57 cm. The lower edge of the sweat band 'B' was sewn to the lower edge of the crown 'C'. In addition, the visor 'A' was sewn to the lower edge of the crown. In such a case, the circumferential length 'r' of the rear portion of the crown was 34.2 cm (3/5×57 cm), while the circumferential length 'f' of the front portion of the crown was 22.8 cm.

The free-size cap of this example is usable by users having head sizes of 57 cm~72 cm.

The above free-size cap is preferable to be used in the summer.

EXAMPLE 2

The process of Example 1 was repeated while making a double-knit weft knitted fabric using spun blend yarns, consisting of 30 wt % of wool and 70 wt % of acryl fiber, instead of the spun blend yarns, consisting of 65 wt % of polyester fiber and 35 wt % of cotton.

The free-size cap of this example is preferable to be used in the winter or in cold climate.

EXAMPLE 3

The process of Example 1 was repeated while making the crown using a double pile weft knitted fabric instead of the double-knit weft knitted fabric.

The free-size cap of this example has cut piles on both surfaces of the crown, and so the cap has a soft touch and a high thermal insulation effect. This free-size cap is thus preferable to be used in the winter or in cold climate.

EXAMPLE 4

The process of Example 1 was repeated while making the double-knit weft knitted fabric of the crown using a spandex-covered yarn manufactured using a spandex monofilament yarn of 70*d* as a core yarn and a polyester multifilament yarn of 150*d* as a cover yarn. The crown of this cap had a weft directional elongation of 60%, a warp direction elongation of 30% and an elastic recovery of 90%.

The tightness of the crown of this free-size cap is more improved than those of the Examples 1 and 2.

EXAMPLE 5

The process of Example 1 was repeated while forming a cutout 'd' at the center of the rear portion of the crown, with a size adjusting means consisting of a female band 'e' and a male band 'g' and being provided at the cutout.

In the above cap, the cutout 'd', having a length of 10 cm and a width of 4 cm, was formed at the center of the lower edge of the rear portion of the crown 'C'. The female band 'e', with a plurality of regularly spaced fitting holes 11 axially arranged on the band, was sewn to the first edge 9 of the cutout 'd' at one end thereof. The male band 'g', with a plurality of regularly spaced fitting projections 12 axially arranged on the band, was sewn to the second edge 10 of the cutout 'd'. The size adjusting means allows a user to primarily and approximately adjust the size of the cap by appropriately engaging the fitting projections 12 of the male band with the fitting holes 11 of the female band in a conventional manner.

In the above free-size cap, the final size adjustment, which is not accomplished by the size adjusting bands due to the intervals of the fitting holes and fitting projections, is automatically and precisely accomplished by both the crown and the sweat band provided at the portions between the first end 7 of the visor and the first edge 9 of the cutout and between the second end 8 of the visor and the second edge 10 of the cutout.

For example, when the free-size cap of FIG. 2 has a reference size of 57 cm and is designed to be commonly usable by users having head sizes different from each other within a difference of about 12 cm, the primary size adjustment within the first 6 cm (57 cm~63 cm) is accomplished by the size adjusting bands with seven fitting holes being formed on the female band while being spaced out at regular intervals of 1 cm. The final size adjustment within the remaining 6 cm (12 cm–6 cm) is automatically and precisely accomplished by both the crown and the sweat band provided at the portions between the first end 7 of the visor and the first edge 9 of the cutout and between the second end 8 of the visor and the second edge 10 of the cutout. That is, since the circumferential length of the portion between the first end 7 of the visor and the first edge 9 of the cutout is 12.1 cm (34.2 cm/2–10 cm/2), the total circumferential length of the two portions between the first end 7 of the visor and the first edge 9 of the cutout and between the second end 8 of the visor and the second edge 10 of the cutout is 24.2 cm (12.1 cm×2). Therefore, when the rear portion of the cap is stretched by 90% of the elongation of 50%, the rear portion is stretched by 10.89 cm (24.2 cm×0.5×0.9). The rear portion is thus stretchable within a range of 10.89 cm, and so the final size adjustment within the remaining 6 cm (12 cm–6 cm) is precisely accomplished by the rear portion. The free-size cap of this invention, which has a reference size of 57 cm and is provided with the size adjusting bands, is usable by a user having a head size of 73 cm (larger than the reference size of 57 cm by 16 cm) in addition to a user having a head size of 69 cm (larger than the reference size of 57 cm by 12 cm).

EXAMPLE 6

The process of Example 5 was repeated while attaching a buckle 'I' and a band 'h' instead of the female band 'e' and the male band 'g' to the cutout 'd' of the crown.

As described above, the present invention provides a free-size cap, with the gores of the crown being made of double-knit weft knitted fabrics having a weft directional elongation higher than 50% and the sweat band being made of an elastic woven fabric having both a weft directional elongation higher than 65% and an elastic recovery higher than 95%. The free-size cap of this invention has five advantages as follows.

First, since the gores of the crown are made of double-knit weft knitted fabrics having a weft directional elongation higher than 50%, the crown almost completely overcomes the problem of a conventional crown made of an elastic woven fabric. That is, stretchable wefts are bound with non-stretchable warps in the elastic woven fabric of the conventional crown, and so the elongation of the crown is remarkably reduced to 25%±2%. However, such a problem is almost completely overcome by the crown made of the double-knit weft knitted fabric of this invention.

Second, the crown of a conventional free-size cap is provided with four or more eyelets for diffusing moisture, such as sweat, from the interior of the crown into the atmosphere. However, the crown of this invention is made of a double-knit weft knitted fabric having loops with a great number of ventilation pores acting as a means for diffusing moisture from the interior of the crown into the atmosphere. Therefore, the free-size cap of this invention is free from such eyelets, and so it is possible to simplify the production process and to reduce the production cost of free-size caps.

Third, since the crown is made of a double-knit weft knitted fabric, the crown feels soft and comfortable to the user while wearing the cap different from a conventional crown made of an elastic woven fabric. The crown of the free-size cap of this invention is appropriately fitted to the head of a user, thus meeting a requirement of users, particularly, young people, wanting to show their personalities with tightly fitted caps.

Fourth, the sweat band of the free-size cap of this invention is made of an elastic woven fabric having both a weft directional elongation higher than 65% and an elastic recovery higher than 95%. When the crown of the cap is stretched by about 12 cm, the sweat band is stretched by about 45% {12 cm÷(3/5×45 cm=0.45)}. The sweat band of this invention thus feels soft and comfortable to the user while wearing the cap. The sweat band of this invention has a great number of ventilation pores, and so the sweat band effectively and quickly absorbs sweat while increasing the absorbable amount of sweat.

Particularly, even though the crown of this invention is made of double-knit weft knitted fabrics having a soft structure almost completely free from automorphism, the sweat band reinforces the soft structure of the crown and accomplishes a desired automorphism of the free-size cap. In addition, the sweat band, having a high elastic recovery, effectively compensates for the low elastic recovery of the crown made of non-stretchable yarns as warps.

Fifth, since the rear portion of both the crown and the sweat band of the free-size cap of this invention is stably stretched by about 12 cm, it is possible for main users having head sizes of 45 cm (infants)~69 cm (adults) to select one of two reference-sized free-size caps, or small-sized caps (45 cm) and medium-sized caps (57 cm). Therefore, the free-size cap of this invention is more convenient to users while selecting the caps different from conventional free-size caps which are manufactured as three reference-sized caps, or small-sized caps, medium-sized caps and large-sized caps. The free-size cap of this invention is convenient to the manufacturers or sellers of caps while producing or selling the caps since the cap of this invention allows the manufacturers or sellers to produce or sell two reference-sized caps instead of the conventional three reference-sized caps.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A free-size cap, comprising:

a plurality of gores integrated into a crown and made of a double-knit weft knitted fabric having a weft directional elongation higher than 50%; and a sweat band attached along a lower edge of the integrated gores and made of an elastic woven fabric, said elastic woven fabric of the sweat band being manufactured by weaving latex-covered yarns as wefts and non-stretchable yarns as warps and having both a weft directional elongation higher than 65% and an elastic recovery higher than 95%.

2. The free-size cap according to claim 1, wherein the double-knit weft knitted fabric of the gores is a double pile weft knitted fabric.

3. The free-size cap according to claim 1, wherein the double-knit weft knitted fabric of the gores is manufactured using polyurethane-covered yarns as wefts.

* * * * *